US010602257B1

(12) United States Patent
Okuda

(10) Patent No.: US 10,602,257 B1
(45) Date of Patent: Mar. 24, 2020

(54) METHODS AND SYSTEMS FOR WIRELESS AUDIO

(71) Applicant: SEMICONDUCTOR COMPONENTS INDUSTRIES, LLC, Phoenix, AZ (US)

(72) Inventor: Kozo Okuda, Hirakata (JP)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 0 days.

(21) Appl. No.: 16/117,400

(22) Filed: Aug. 30, 2018

(51) Int. Cl.
*H04R 1/10* (2006.01)
*G10K 11/178* (2006.01)
*G10L 21/02* (2013.01)

(52) U.S. Cl.
CPC ..... *H04R 1/1041* (2013.01); *G10K 11/17823* (2018.01); *G10K 11/17853* (2018.01); *G10L 21/0205* (2013.01); *H04R 1/1016* (2013.01); *H04R 1/1083* (2013.01); *G10K 2210/1081* (2013.01); *G10K 2210/3028* (2013.01); *G10K 2210/3046* (2013.01); *H04R 2420/07* (2013.01)

(58) Field of Classification Search
CPC ..... H04R 2420/07; H04R 2225/55; H04R 25/552; H04R 5/033; H04R 1/1041; H04R 1/1016; H04R 1/1083; G10K 11/17823; G10K 11/17853; G10K 2210/1081; G10K 2210/3028; G10K 2210/3046; G10K 2420/07; G10L 21/0205
USPC ..... 381/312, 314, 315, 71.6, 311, 309, 74, 381/334, 370
See application file for complete search history.

(56) References Cited

U.S. PATENT DOCUMENTS

2004/0037442 A1 2/2004 Nielsen
2004/0136555 A1 7/2004 Enzmann
2008/0226094 A1* 9/2008 Rutschman ..... H04M 1/6066 381/79
2013/0293723 A1* 11/2013 Benson ..... G02B 27/017 348/164
2014/0093085 A1* 4/2014 Jarvis ..... H04R 27/00 381/17
2014/0143582 A1* 5/2014 Kindred ..... G06F 1/12 713/400
2017/0098466 A1* 4/2017 Elliot ..... G11B 27/10
2019/0261089 A1* 8/2019 Hariharan ..... H04R 1/1016

* cited by examiner

*Primary Examiner* — Norman Yu
(74) *Attorney, Agent, or Firm* — The Noblitt Group, PLLC; Hettie L. Haines

(57) ABSTRACT

Various embodiments of the present technology comprise a method and system for wireless audio. In various embodiments, the system comprises a set of wirelessly connected ear buds, each ear bud suitable for placing in a human ear canal. Each ear bud comprises a microphone, an asynchronous sampling rate converter, a timer, and an audio clock. One ear bud from the set further comprises a control circuit and a synchronizer to synchronize the input of sound signals captured by the microphones and/or synchronize the processing and output of the sound signals.

20 Claims, 6 Drawing Sheets

METHODS AND SYSTEMS FOR WIRELESS AUDIO

BACKGROUND OF THE TECHNOLOGY

A variety of audio and/or hearing devices exist that provide a user with audio from an electronic device, such as a cell phone, provide a user with enhanced sounds and speech, such as a medical hearing aid, and/or provide a user with active noise control and/or noise cancellation. Many of these audio and hearing devices are wireless, such as wireless "ear buds." In conventional wireless ear buds, however, each earpiece operates separately and independent from the other to perform active noise control and/or noise cancellation. Therefore, they cannot effectively utilize conventional speech enhancement methods and techniques.

SUMMARY OF THE INVENTION

Various embodiments of the present technology comprise a method and system for wireless audio. In various embodiments, the system comprises a set of wirelessly connected ear buds, each ear bud suitable for placing in a human ear canal. Each ear bud comprises a microphone, an asynchronous sampling rate converter, a timer, and an audio clock. One ear bud from the set further comprises a control circuit and a synchronizer to synchronize the input of sound signals captured by the microphones and/or synchronize the processing and output of the sound signals.

BRIEF DESCRIPTION OF THE DRAWING FIGURES

A more complete understanding of the present technology may be derived by referring to the detailed description when considered in connection with the following illustrative figures. In the following figures, like reference numbers refer to similar elements and steps throughout the figures.

Figure 3:
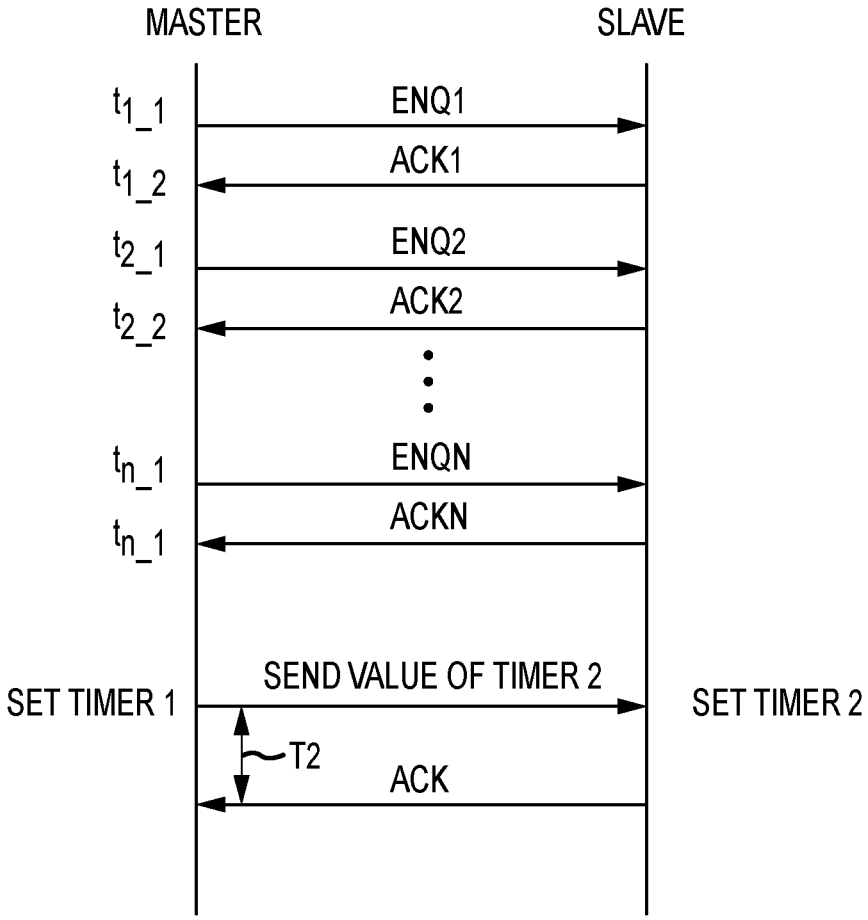
Figure 4:
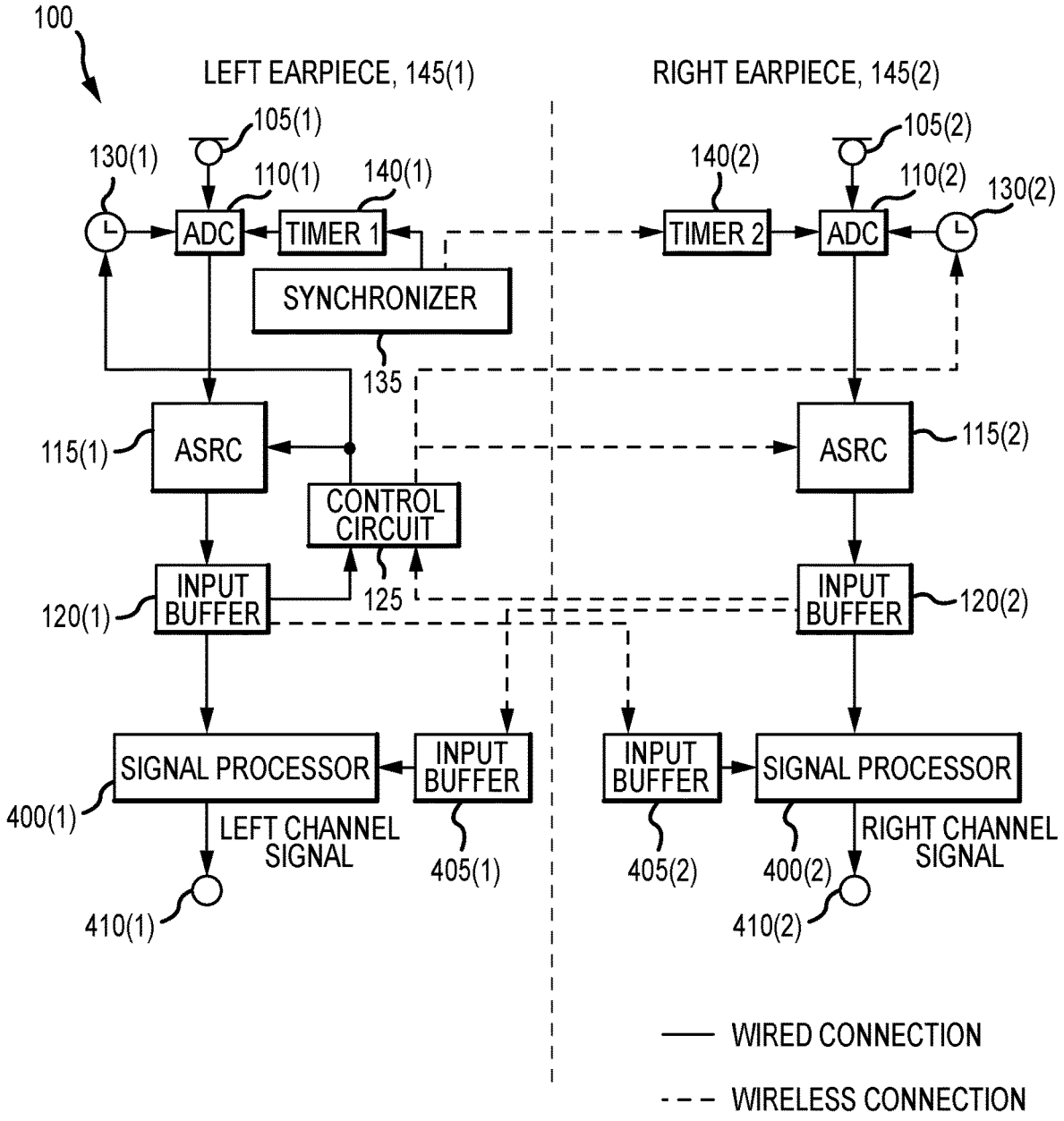
Figure 5:
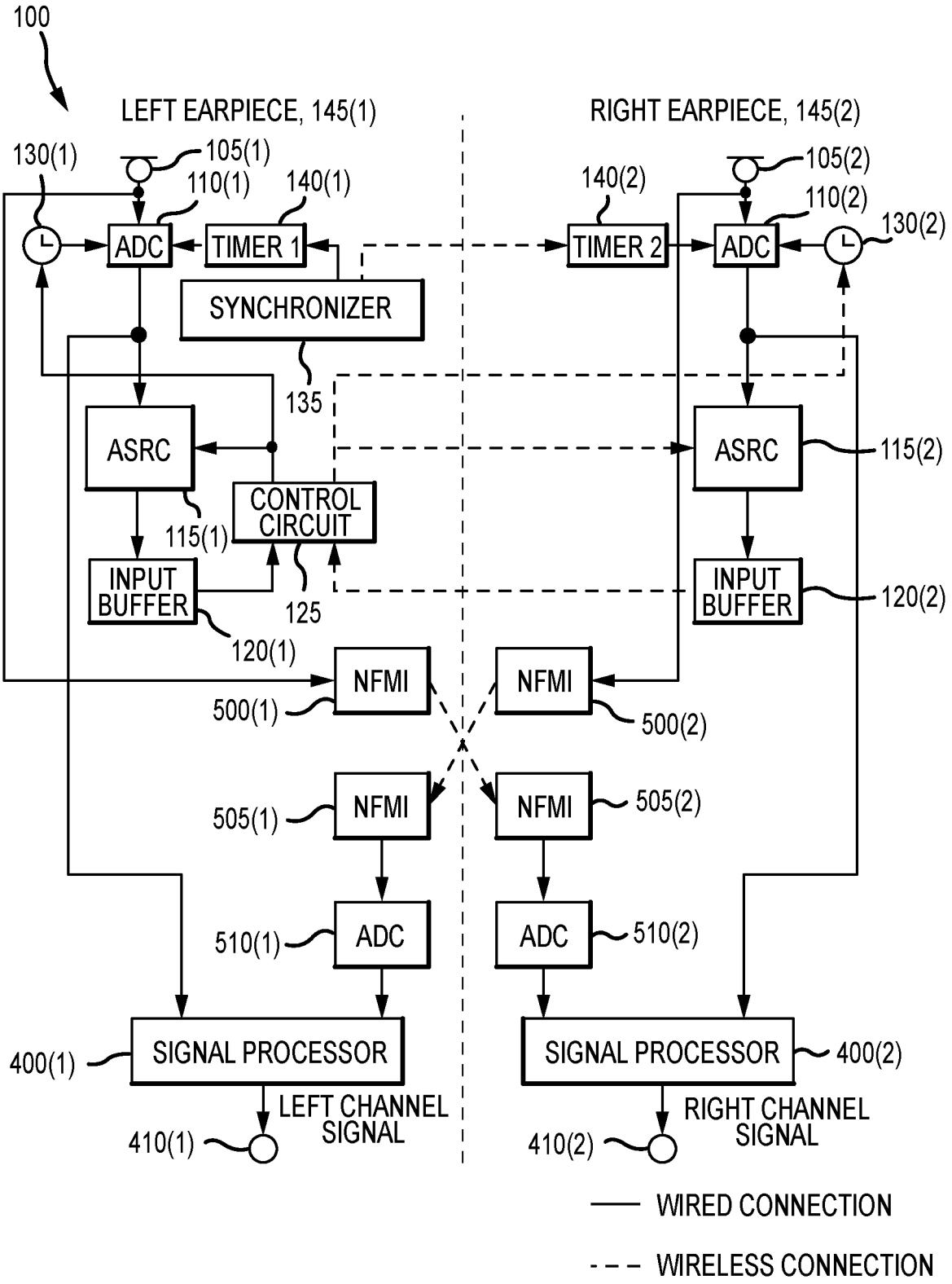
Figure 6:
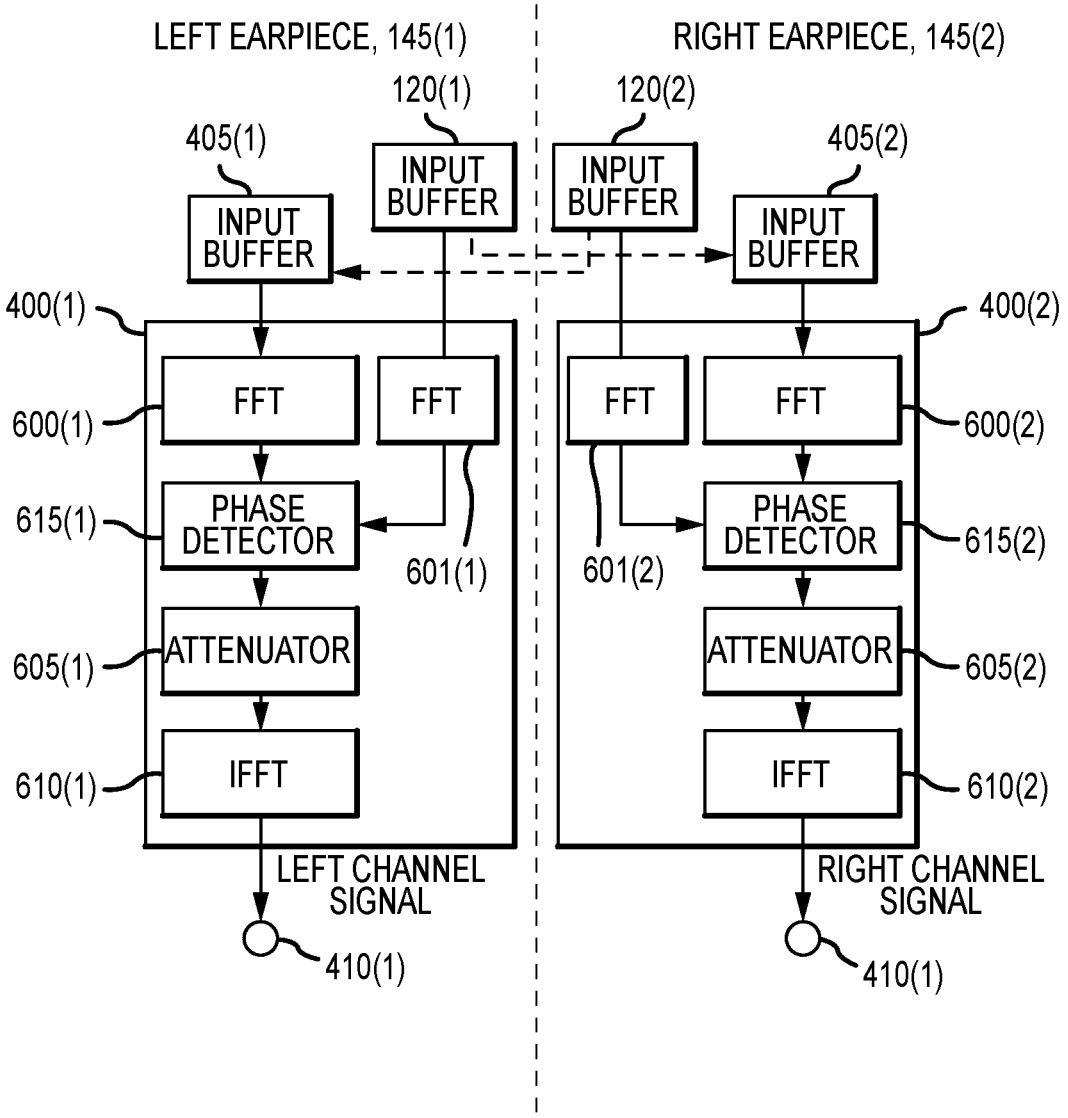

FIG. 3 representatively illustrates communication between a set of hearing devices in the wireless audio system in accordance with an exemplary embodiment of the present technology;

FIG. 4 is a block diagram of a wireless audio system that utilizes a first wireless data exchange system in accordance with an exemplary embodiment of the present technology;

FIG. 5 is a block diagram of a wireless audio system that utilizes a second wireless data exchange system in accordance with an exemplary embodiment of the present technology; and FIG. 6 is a block diagram of a wireless audio system comprising a speech enhancement function in accordance with an exemplary embodiment of the present technology.

DETAILED DESCRIPTION OF EXEMPLARY EMBODIMENTS

The present technology may be described in terms of functional block components and various processing steps. Such functional blocks may be realized by any number of components configured to perform the specified functions and achieve the various results. For example, the present technology may employ various clocks, timers, buffers, analog-to-digital converters, microphones, asynchronous sampling rate converters, which may carry out a variety of functions. In addition, the present technology may be practiced in conjunction with any number of audio systems, such as medical hearing aids, audio earpieces (i.e., ear buds) and the like, and the systems described are merely exemplary applications for the technology. Further, the present technology may employ any number of conventional techniques for exchanging data, (either wirelessly or electrically), providing speech enhancement, attenuating desired frequencies, and the like.

Methods and systems for wireless audio according to various aspects of the present technology may operate in conjunction with any suitable electronic system and/or device, such as "smart devices," wearables, consumer electronics, portable devices, audio players, and the like.

Figure 1:
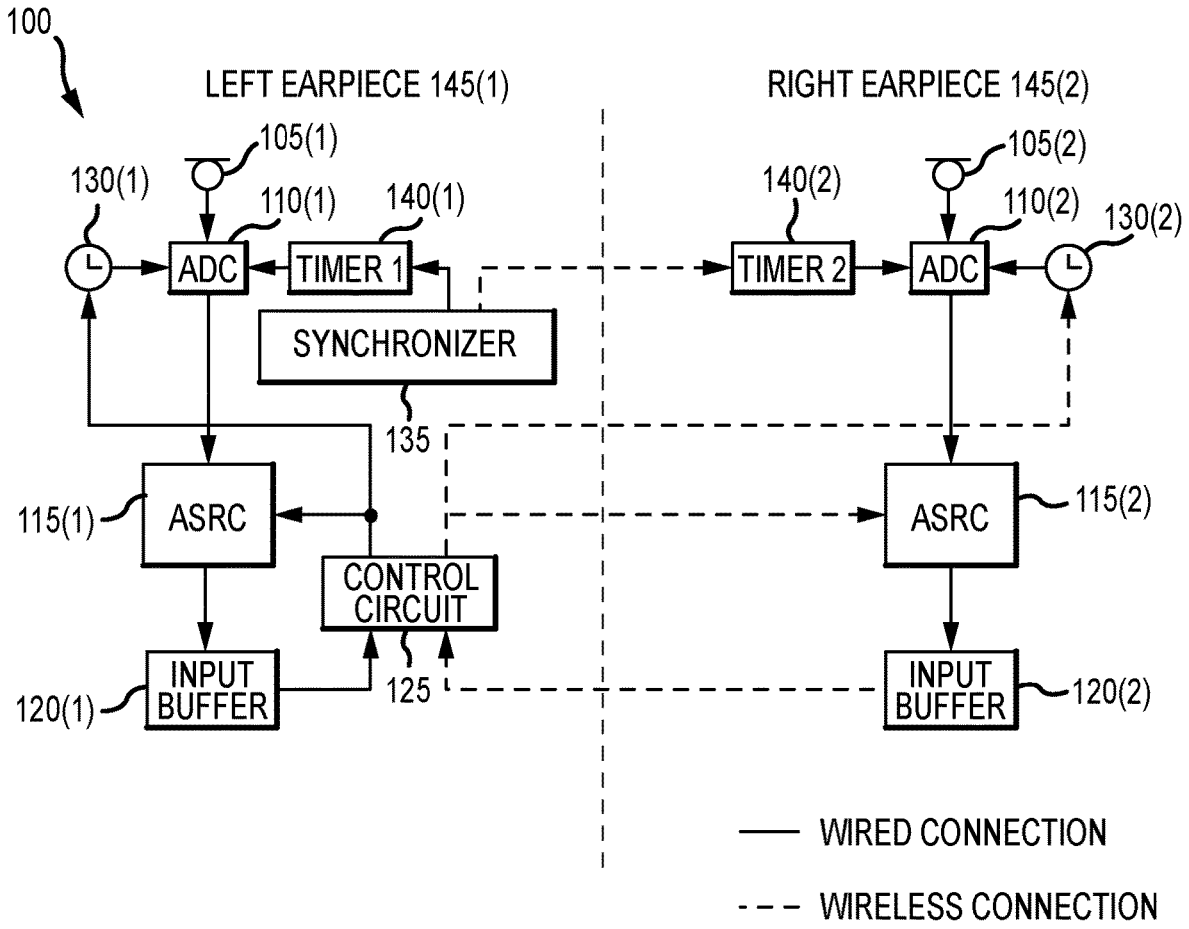
FIG. 1 is a block diagram of a wireless audio system in accordance with an exemplary embodiment of the present technology.

Referring to FIG. 1, an audio system 100 may comprise various components suitable for detecting sound signals, producing sound signals, and/or attenuating sound signals. For example, the audio system 100 may comprise various microphones, speakers, and processing circuits that operate together to cancel noise, enhance desired speech or sounds, and/or produce pre-recorded sound. In an exemplary embodiment, the audio system 100 is configured to be worn by a human (a user) and positioned in or near the human ear canal. An exemplary audio system 100 may comprise a set of earpieces, such as a left earpiece 145(1) (a left ear bud) and a right earpiece 145(2) (a right ear bud).

The audio system 100 may be further configured for selective operation of the audio system 110 by the user. For example, the audio system 100 may have a manual control (not shown) that allows the user to set the operation of the audio system 100 to a desired mode. For example, the audio system 100 may comprise a listening mode, an ambient mode, and a noise cancelling mode. The listening mode may be suitable for communicating with a person standing in front of the user. In the listening mode, all other sounds other than the person's speech are attenuated. The ambient mode may be suitable for providing safety and may attenuate human speech but amplify and/or pass other environmental sounds, such as car noise, train noise, and the like. The noise cancelling mode may be suitable for relaxation and may attenuate all noises. The noise cancelling mode may be activated at the same time as the audio system 100 is producing pre-recorded sound.

The audio system 100 may comprise any suitable device for manually controlling or otherwise setting the desired mode of operation. For example, the earpiece 145 and/or a communicatively coupled electronic device, such as a cell phone, may comprise a switch, dial, button, and the like, to allow the user to manually control the mode of operation.

According to various embodiments, the audio system 100 may further employ any suitable method or technique for transmitting/receiving data, such as through a wireless communication system. For example, the audio system 100 may employ a wireless communication between a master device and a slave device, such as a "Bluetooth" communication system, or through a near-filed magnetic induction communication system.

Each earpiece 145 provides various audio to the user. The set of earpieces 145(1), 145(2) operate in conjunction with each other and may be configured to synchronize with each other to provide the user with synchronized audio. The set of earpieces 145(1), 145(2) may be further configured to process sound, such as provide speech enhancement and attenuate desired frequencies. According to various embodiments, the set of earpieces 145(1), 145(2) are configured to detect sound and transmit sound.

According to various embodiments, each earpiece 145 is shaped to fit in or near a human ear canal. For example, a portion of the earpiece 145 may block the ear canal, or the earpiece 145 may be shaped to fit over the outer ear. According to an exemplary embodiment, the left and right earpieces 145(1), 145(2) communicate with each other via a wireless connection. According to various embodiments, the left and right earpieces 145(1), 145(2) may also communicate via a wireless connection with an electronic device, such as a cell phone.

Each earpiece 145 may comprise a microphone 105 to detect sound in the user's environment. For example, the left earpiece 145(1) comprises a first microphone 105(1) and the right earpiece 145(2) comprises a second microphone 105(2). The microphone 105 may be positioned on an area of the earpiece 145 that faces away from the ear canal to detect sounds in front of and/or around the user. The microphone 105 may comprise any device and/or circuit suitable for detecting a range of sound frequencies and generating an analog sound signal in response to the detected sound.

Each earpiece 145 may further comprise an analog-to-digital converter (ADC) 110 to convert an analog signal to a digital signal. For example, the left earpiece 145(1) comprises a first ADC 110(1) and the right earpiece 145(2) comprises a second ADC 110(2). The ADC 110 may be connected to the microphone 105 and configured to receive the analog sound signals from the microphone 105. For example, the first ADC 110(1) is connected to and receives sound signals from the first microphone 105(1) and the second ADC 110(2) is connected to and receives sound signals from the second microphone 105(2). The ADC 110 processes the analog sound signal from the microphone 105 and converts the analog sound signal to a digital sound signal. The ADC 110 may comprise any device and/or circuit suitable for converting an analog signal to a digital signal and may comprise any suitable ADC architecture.

Each earpiece 145 may comprise an asynchronous sampling rate converter (ASRC) 115 to change the sampling rate of a signal to obtain a new representation of the underlying signal. For example, the left earpiece 145(1) comprises a first ASRC 115(1) and the right earpiece 145(2) comprises a second ASRC 115(2). The ASRC 115 may be connected to an output terminal of the ADC 110 and configured to receive the digital sound signal. For example, the first ASRC 115(1) is connected to and receives digital sound signals from the first ADC 110(1) and the second ASRC 115(2) is connected to and receives digital sound signals from the second ADC 110(2). The ASRC 115 may comprise any device and/or circuit suitable for sampling and/or converting data at according to an asynchronous, time-varying rate. According to an exemplary embodiment, each ASRC 115 is electrically connected to the respective ADC 110. Alternative embodiments may, however, employ a wireless connection.

Each earpiece 145 may further comprise an input buffer 120 to receive and hold incoming data. For example, the left earpiece 145(1) comprises a first input buffer 120(1) and the right earpiece 145(2) comprises a second input buffer 120(2). The input buffer 120 may be connected to an output terminal of the ASRC 115. For example, the first input buffer 120(1) is connected to and receives and stores an output from the first ASRC 115(1) and the second input buffer 120(2) is connected to and receives and stores an output from the second ASRC 115(2). The input buffer 120 may comprise any memory device and/or circuit suitable for temporarily storing data.

According to an exemplary embodiment, each input buffer 120 is electrically connected to the respective ASRC 115. Alternative embodiments may, however, employ a wireless connection.

Each earpiece 145 may further comprise an audio clock 130 to generate a clock signal. In various embodiments, the ADC 110 receives and operates according to the clock signal. For example, the left earpiece 145(1) comprises a first audio clock 130(1) configured to transmit a first clock signal to the first ADC 110(1) and the right earpiece 145(2) comprises a second audio clock 130(2) configured to transmit a second clock signal to the second ADC 110(2). The audio clock 130 may comprise any suitable clock generator circuit.

According to an exemplary embodiment, the first and second audio clocks 130(1), 130(2) may be configured to operate at a predetermined frequency, for example 16 kHz. While each audio clock 130 is configured to operate at the same predetermined frequency, variations between the first and second audio clocks 130(1), 130(2) may create some slight differences in the frequency and/or put the two clocks 130(1), 130(2) out of phase from each other. Variations between the first and second audio clocks 130(1), 130(2) may be due to manufacturing differences, variations in the components, and the like.

According to an exemplary embodiment, each audio clock 130 is electrically connected to the respective ADC 110. Alternative embodiments may, however, employ a wireless connection.

Each earpiece 145 may further comprise a timer 140 to provide time delays, operate as an oscillator, and/or operate as a flip-flop element. In various embodiments, the ADC 110 receives and operates according to the timer 140 and in conjunction with the audio clock 130. For example, the left earpiece 145(1) comprises a first timer 140(1) configured to transmit a first timer signal to the first ADC 110(1) and the right earpiece 145(2) comprises a second timer 140(2) configured to transmit a second timer signal to the second ADC 110(2).

According to an exemplary embodiment, each timer 140 is electrically connected to the respective ADC 110. Alternative embodiments may, however, employ a wireless connection.

The audio system 100 may further comprise a control circuit 125 configured to generate and transmit various control signals to the ASRC 115 and the audio clock 130. For example, the control circuit 125 may be communicatively coupled to the first and second ASRCs 115(1), 115(2) and configured to generate and transmit an ASRC control signal to each ASRC substantially simultaneously. The control circuit 125 may be implemented in either the left earpiece 145(1) or the right earpiece 145(2). According to an exemplary embodiment, the control circuit 125 is implemented in the left earpiece 145(1) and therefore the ASRC control signal may reach the first ASRC 115(1) slightly sooner (e.g., 1 millisecond) than the second ASRC 115(2) due to the slightly longer distance that the signal must travel.

Similarly, the control circuit 125 may be configured to generate and transmit a clock control signal to the audio clock 130. For example, the control circuit 125 may be communicatively coupled to the first and second audio clocks 130(1), 130(2) and configured to transmit the clock control signal to each clock substantially simultaneously.

According to an exemplary embodiment where the control circuit 125 is implemented in the left earpiece 145(1), the control circuit 125 is electrically connected to the first input buffer 120(1), the first ASRC 115(1), and the first audio clock 130(1). Further, the control circuit 125 is wirelessly connected to the second input buffer 120(2), the second ASRC 115(2), and the second audio clock 130(2).

However, in an alternative embodiment, the control circuit 125 may be implemented in the right earpiece 145(2) and is electrically connected to second input buffer 120(2), the second ASRC 115(2), and the second audio clock 130(2). In the present embodiment, the control circuit 125 is wirelessly connected to the first input buffer 120(1), the first ASRC 115(1), and the first audio clock 130(1).

The audio system 100 may further comprise a synchronizer circuit 135 configured to synchronize a start time for operating the first and second ADCs 110(1), 110(2). For example, the synchronizer circuit 135 may generate a timer signal and transmit the timer signal to each of the first and second timers 140(1), 140(2) substantially simultaneously. The synchronizer circuit 135 may be implemented in either the left earpiece 145(1) or the right earpiece 145(2). According to an exemplary embodiment, the synchronizer circuit 135 is implemented in the left earpiece 145(1) and therefore the timer signal may reach the first timer 140(1) slightly sooner (e.g., 1 millisecond) than the second timer 140(2) due to the slightly longer distance that the signal must travel.

According to an exemplary embodiment where the synchronizer circuit 135 is implemented in the left earpiece 145(1), the synchronizer circuit 135 is electrically connected to the first timer 140(1) and wirelessly connected to the second timer 140(2). However, in an alternative embodiment, the synchronizer circuit 135 may be implemented in the right earpiece 145(2) and electrically connected to the second timer 140(2) and wirelessly connected to the first timer 140(1).

According to various embodiments, the control circuit 125 and the synchronizer circuit 135 operate in conjunction with each other to synchronize an operation start time for operating the first and second ADCs 110(1), 110(2), which in turn synchronizes the operation of the first and second ASRCs 115(1), 115(2) and the first and second input buffers 120(1), 120(2). Accordingly, the left and right earpieces 145(1), 145(2) are synchronized with each other and generate output signals, such as a left channel signal and right channel signal, simultaneously.

Referring to FIGS. 4 and 5, according to various embodiments, the left and right earpieces 145(1), 145(2) communicate with each other using a wireless communication system. For example, and referring to FIG. 4, the audio system 100 may operate using a Bluetooth wireless communication system. In the present embodiment, the audio system 100 may further comprise a second set of input buffers, such as a third input buffer 405(1) and fourth input buffer 405(2), wherein the third input buffer 405(1) may be wirelessly connected to the second input buffer 120(2) and configured to receive data from the second input buffer 120(2). Similarly, the fourth input buffer 405(2) may be wirelessly connected to the first input buffer 120(1) and configured to receive data from the first input buffer 120(1).

According to an alternative communication method, and referring to FIG. 5, the left and right earpieces 145(1), 145(2) communicate with each other using a near-field magnetic induction (NFMI) communication system. According to the present embodiment, the audio system 100 may further comprise a NFMI transmitter 500 and a NFMI receiver 505. For example, the left earpiece 145(1) may comprise a first NFMI transmitter 500(1) connected to the first microphone 105(1) and a first NFMI receiver 505(1). The right earpiece 145(2) may comprise a second NFMI transmitter 500(2) connected to the second microphone 105(2) and a second NFMI receiver 505(2). The first NFMI transmitter 500(1) may be configured to transmit data to the second NFMI receiver 505(2) and the second NFMI transmitter 500(2) may be configured to transmit data to the first NFMI receiver 505(1). Each NFMI receiver 505 may be connected to an ADC 510. For example, the first NFMI receiver 505(1) may be connected to a third ADC 510(1) and the second NFMI receiver 505(2) may be connected to a fourth ADC 510(2).

According to various embodiments, the audio system 100 may further comprise a signal processor 400 configured to process the sound data and generate the output signals, such as the left channel signal and the right channel signal, and transmit the output signals to a respective speaker 410. For example, the left earpiece 145(1) may further comprise a first speaker 410(1) to receive the left channel signal and the right earpiece 145(2) may further comprise a second speaker 410(2) to receive the right channel signal.

In one embodiment, and referring to FIG. 4, a first signal processor 400(1) is connected to the first and third input buffers 120(1), 405(1), and a second signal processor 400(2) is connected to the second and fourth input buffers 120(2), 405(2). The first signal processor 400(1) may generate the left channel signal according to data from the first and third input buffers 120(1), 405(1), and the second signal processor 400(2) may generate the right channel signal according to data from the second and fourth input buffers 120(2), 405(2).

In an alternative embodiment, and referring to FIG. 5, the first signal processor 400(1) is connected to the first ADC 110(1) and the third ADC 510(1), and the second signal processor 400(2) is connected to the second ADC 110(2) and the fourth ADC 510(2). The first signal processor 400(1) may generate the left channel signal according to data from the first ADC 110(1) and the third ADC 510(1), and the second signal processor 400(2) may generate the right channel signal according to data from the second ADC 110(2) and the fourth ADC 510(2).

According to various embodiments, the signal processor 400 may be configured to process the sound data according to the desired mode of operation, such as the listening mode, the ambient mode, and the noise cancelling mode. For example, the signal processor 400 may be configured perform multiple data processing methods to accommodate each mode of operation, since each mode of operation may require different signal processing methods.

The audio system 100 may be configured to distinguish the location of a sound source. For example, the audio system 100 may be able to determine if the sound is coming from a source that is located directly in front of the user (i.e., the sound source is located substantially the same distance from the first microphone 105(1) and the second microphone 105(2)). According to the present embodiment, the audio system 100 uses phase information and/or signal power from the first and second microphones 105(1), 105(2) to determine the location of the sound source. For example, the audio system 100 may be configured to compare the phase information from the first and second microphones 105(1), 105(2). In general, when the sound comes from a central location, the phase and power of the audio signals from the first and second microphones 105(1), 105(2) are substantially the same. However, when the sound comes from some other direction, the phase and power of the audio signals will differ. This method of signal processing may be referred to as "center channel focus" and may be utilized during listening mode.

According to an exemplary embodiment, and referring to FIG. 6, the center channel focus method may be realized by exchanging data between the first and second signal processors 400(1), 400(2) and processing the data in a particular manner. For example, each signal processor 400 may comprise a first fast Fourier transform (FFT) circuit 600 and a second fast Fourier transform circuit 601, each configured to perform a fast Fourier transform algorithm, a phase detector circuit 615 configured to compare two phases, an attenuator 605 configured to attenuate one or more desired frequencies and/or provide gain control according to an output of the phase detector circuit 615, and an inverse fast Fourier transform circuit 610 configured to perform an inverse fast Fourier transform algorithm to convert the sound data into a time domain signal.

According to an exemplary embodiment, and referring to the left earpiece 145(1), the first FFT circuit 600 transforms the signal from right earpiece 145(2), via the second and third input buffers 120(2), 405(1), and the second FFT circuit 601 transforms the signal of the left earpiece 145(1) via the first input buffer 120(1). The first and second FFT circuits 600, 601 each output a transformed signal and transmit the transformed signal to the phase detector circuit 615. Each phase detector circuit 615 receives and analyzes data from the first and second microphones 105(1), 105(2), via the first and second FFT circuits 600, 601. Each phase detector 405 compares the phases of data from each microphone 105(1), 105(2), determines which frequency bins contains the sound from the central location, and attenuates the frequency bins that contain sound from non-central locations (locations outside the central location).

The center channel focus method may be implemented in conjunction with any suitable wireless communication system. For example, the center channel focus method may be implemented in conjunction with the Bluetooth wireless communication system and the NFMI wireless communication system.

According to various and/or alternative embodiments, the signal processor 400 may be further configured to perform other methods of speech enhancement and/or attenuation. For example, the audio system 100 and/or the signal processor 400 may be comprise various circuits and perform various signal processing methods to attenuate sound during the noise cancelling mode and the ambient mode.

Figure 2:
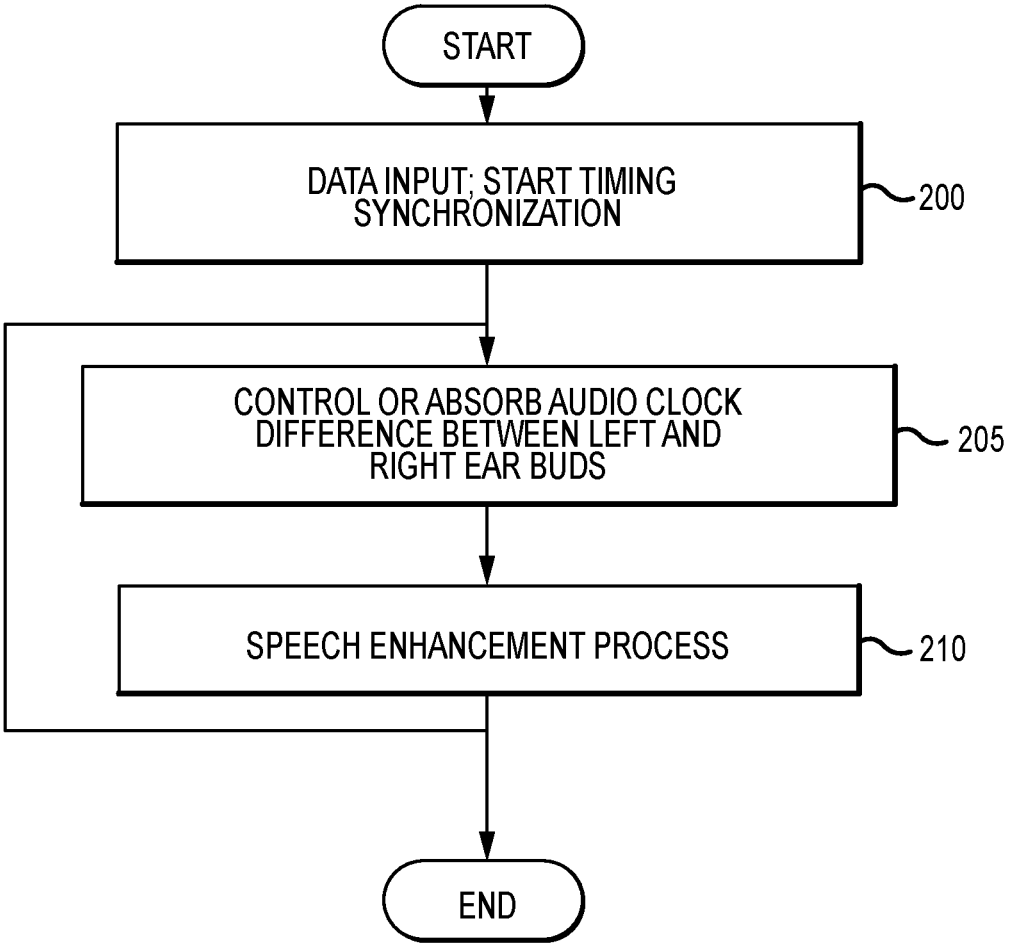
FIG. 2 is a flow chart for operating the wireless audio system in accordance with an exemplary embodiment of the present technology.

In operation, and referring to FIGS. 1-3, the audio system 100 may first synchronize the start time for inputting data from the first and second ADCs 110(1), 110(2) to the first and second ASRCs 115(1), 115(2), respectively (200). For example, and referring to FIG. 3, the synchronizer circuit 135 may be configured to measure an amount of time it takes to send an enquiry signal to the timer 140 and receive an acknowledgment signal. In the present embodiment, the synchronizer circuit 135 operates as a master device and the second timer 140(2) operates as a slave device. The synchronizer circuit 135 transmits a first enquiry signal Enq1 to the second timer 140(2) and receives a first acknowledgement signal Ack1 back from the second timer 140(2). The synchronizer circuit 135 then transmits a second enquiry signal Enq2 to the second timer 140(2) and receives a second acknowledgment signal Ack2 back. The synchronizer circuit 135 may perform this sequence a number of times *n* to determine an average travel time $T_{timer}$. The average travel time $T_{timer}$ from the master device to slave device is described as follows:

$$T_{timer} = \frac{\sum_{i=1}^{n} (t_{i-2} - t_{i-1})}{2n}$$

The synchronizer circuit 135 may then set the first timer 140(1) to a value equal to twice the average travel time $T_{timer}$ (i.e., timer_1=2*$T_{timer}$) and set the second timer 140(2) to a value equal to the average travel time $T_{timer}$ (i.e., timer_2=$T_{timer}$). The synchronizer circuit 135 then receives an acknowledgment signal Ack from the second timer 140(2) and determines a second travel time T2. The second travel time T2 is the time from release of the "send value of timer 2" signal to the time of receipt of the acknowledgment signal Ack. It may be desired that the second travel time T2 is equal to the value of the first timer 140(1) (i.e., T2=2*$T_{timer}$). If the second travel time T2 is equal to the timer 1 value plus/minus a predetermined tolerance value Δ, then the timing is synchronized and the first and second timers 140(1), 140(2) activate operation of the first and second ADCs 110(1), 110(2), respectively. If the second travel time T2 is greater than the timer 1 value plus the predetermined tolerance value (T2>timer_1+Δ) or if the second travel time T2 is less than the timer 1 value minus the predetermined tolerance value (T2<timer_1−Δ), then the synchronizer circuit 135 rechecks the second travel time T2 value by sending a new "send value of timer 2" signal and waiting for a new acknowledgment signal to acquire a new second travel time. If the synchronizer circuit 135 rechecks the second travel time T2 and the new second travel time is still not within the predetermined tolerance within a predetermined number of cycles, then the synchronizer circuit 135 starts over and generates a new travel time value and new values for the first and second timers 140(1), 140(2) (e.g., timer_1, timer_2) according to the same process described above.

Referring again to FIG. 2, the audio system 100 may then control differences between the first and second audio clocks 130(1), 130(2). For example, the audio system 100 may utilize the control circuit 125 in conjunction with the first and second input buffers 120(1), 120(2) to determine if an actual number of samples processed by each ASRC 115 and transmitted to the respective input buffer 120 match expected number of samples. The expected number of samples is described as follows:

$$\text{d2_cnt1} = \frac{\text{d1_cnt1} + \text{d1_cnt2}}{2}$$

In the above equation, d1_cnt1 is the number of data samples from the first input buffer 120(1) at time N=1, d2_cnt1 is the number of data samples from the second input buffer 120(2) at time N=1, and d1_cnt2 is a number of data samples from the first input buffer 120(1) at time N=2. If the audio system 100 is synchronized, then the equation above holds true. However, if d2_cnt1 is not equal to the expression (d1_cnt1+d1_cnt2)/2, then the audio system 100 may adjust a conversion ratio of the first ASRC 115(1) or the second ASRC 115(2). Alternatively, the audio system 100 may adjust the frequency of the first audio clock 130(1) or the second audio clock 130(2).

For example, if d2_cnt1 is greater than the expression (d1_cnt1+d1_cnt2)/2, then the control circuit 125 may increase the conversion ratio of the first ASRC 115(1) or decrease the conversion ratio of the second ASRC 115(2). Alternatively, the control circuit 125 may increase the frequency of the first audio clock 130(1) or decrease the frequency of the second audio clock 130(2).

If d2_cnt1 is less than the expression (d1_cnt1+d1_cnt2)/2, then the control circuit 125 may decrease the conversion ratio of the first ASRC 115(1) or increase the conversion ratio of the second ASRC 115(2). Alternatively, the control circuit 125 may decrease the frequency of the first audio clock 130(1) or increase the frequency of the second audio clock 130(2).

The audio system 100 may then perform various speech enhancement processes, such as the center channel focus process described above, or provide other noise cancelling or noise attenuating processes based on the users desired operation mode, such as the noise cancelling mode or the ambient mode. The audio system 100 may be configured to continuously control the ASRC 115 and/or the audio clock 130 and update the signal processing methods as the user changes the mode of operation.

In the foregoing description, the technology has been described with reference to specific exemplary embodiments. The particular implementations shown and described are illustrative of the technology and its best mode and are not intended to otherwise limit the scope of the present technology in any way. Indeed, for the sake of brevity, conventional manufacturing, connection, preparation, and other functional aspects of the method and system may not be described in detail. Furthermore, the connecting lines shown in the various figures are intended to represent exemplary functional relationships and/or steps between the various elements. Many alternative or additional functional relationships or physical connections may be present in a practical system.

The technology has been described with reference to specific exemplary embodiments. Various modifications and changes, however, may be made without departing from the scope of the present technology. The description and figures are to be regarded in an illustrative manner, rather than a restrictive one and all such modifications are intended to be included within the scope of the present technology. Accordingly, the scope of the technology should be determined by the generic embodiments described and their legal equivalents rather than by merely the specific examples described above. For example, the steps recited in any method or process embodiment may be executed in any order, unless otherwise expressly specified, and are not limited to the explicit order presented in the specific examples. Additionally, the components and/or elements recited in any apparatus embodiment may be assembled or otherwise operationally configured in a variety of permutations to produce substantially the same result as the present technology and are accordingly not limited to the specific configuration recited in the specific examples.

Benefits, other advantages and solutions to problems have been described above with regard to particular embodiments. Any benefit, advantage, solution to problems or any element that may cause any particular benefit, advantage or solution to occur or to become more pronounced, however, is not to be construed as a critical, required or essential feature or component.

The terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present technology, in addition to those not specifically recited, may be varied or otherwise particularly adapted to specific environments, manufacturing specifications, design parameters or other operating requirements without departing from the general principles of the same.

The present technology has been described above with reference to an exemplary embodiment. However, changes and modifications may be made to the exemplary embodiment without departing from the scope of the present technology. These and other changes or modifications are intended to be included within the scope of the present technology, as expressed in the following claims.

The invention claimed is:

1. A wireless audio system, comprising:

a first ear bud connected to a second ear bud via a wireless communication system;

wherein:

the first ear bud comprises:

a first microphone configured to generate first sound data;

a first timer; and a first audio clock configured to operate at a predetermined frequency; wherein the first timer and the first audio clock are independent from each other; and the second ear bud comprises:

a second microphone configured to generate second sound data;

a second timer; and a second audio clock configured to operate at the predetermined frequency; wherein the second timer and the second audio clock are independent from each other; and wherein one of the first ear bud and the second ear bud comprises:

a synchronizer circuit configured to synchronize the first and second timers with each other via the wireless communication system; and a control circuit connected to the first and second audio clocks via the wireless communication system.

2. The wireless audio system according to claim 1, wherein the wireless communication system comprises at least one of: a Bluetooth communication system and a near-field magnetic induction communication system.

3. The wireless audio system according to claim 1, wherein:

the first ear bud further comprises a first analog-to-digital converter (ADC) electrically connected to the first microphone and responsive to:

the first timer; and the first audio clock; and the second ear bud further comprises a second analog-to-digital converter electrically connected to the second microphone and responsive to:

the second timer; and the second audio clock.

4. The wireless audio system according to claim 3, wherein:

the first ear bud further comprises a first asynchronous sampling rate converter (ASRC) electrically connected to an output terminal of the first ADC and electrically connected to the control circuit; and the second ear bud further comprises a second asynchronous sampling rate converter (ASRC) electrically connected to an output terminal of the second ADC and wirelessly connected to the control circuit.

5. The wireless audio system according to claim 4, wherein:

the first ear bud further comprises a first input buffer electrically connected to the first microphone and electrically connected to the control circuit; and the second ear bud further comprises a second input buffer electrically connected to the second microphone and wirelessly connected to the control circuit.

6. The wireless audio system according to claim 4, wherein the control circuit is configured to:

compare an actual number of samples from the second ASRC to an expected number of samples from the second ASRC; and adjust at least one of the first ASRC, the second ASRC, the first audio clock, and the second audio clock according to the comparison.

7. The wireless audio system according to claim 1, further comprising a signal processor located in one of the first ear bud and the second ear bud and configured to perform speech enhancement using a center channel focus processing method.

8. The wireless audio system according to claim 1, wherein the synchronizer circuit is configured to:

determine a wireless travel time from the synchronizer circuit to the second timer; and synchronize the first timer with the second timer according to the wireless travel time.

9. A method for synchronizing a first earpiece and a second earpiece, comprising:

connecting, via a wireless communication system, the first earpiece and the second earpiece; wherein:

the first earpiece comprises:

a first microphone;

a first timer;

a first asynchronous sampling rate converter (ASRC); and a first audio clock, independent from the first timer, configured to operate at a predetermined frequency;

the second earpiece comprises:

a second microphone;

a second timer;

a second ASRC; and a second audio clock, independent from the second timer, configured to operate at the predetermined frequency;

synchronizing first input sound data from the first microphone with second input sound data from the second microphone via the wireless communication system; and selectively controlling operation of the first and second earpieces via the wireless communication system.

10. The method according to claim 9, wherein synchronizing the first input sound data with second input sound data comprises:

determining a wireless travel time from the synchronizer circuit to the second timer; and synchronizing the first timer with the second timer according to the wireless travel time.

11. The method according to claim 9, wherein selectively controlling the operation of the first and second earpieces comprises:

comparing an actual number of samples from the second ASRC to an expected number of samples from the second ASRC; and adjusting at least one of the first ASRC, the second ASRC, the first audio clock, and the second audio clock according to the comparison.

12. The method according to claim 9, further comprising processing the first and second sound data according to a selected mode of operation, wherein the mode of operation comprises: a noise cancelling mode, an ambient mode, and a listening mode.

13. An audio system, comprising:

a first earpiece comprising:

a first microphone;

a first analog-to-digital converter (ADC) configured to receive first sound data from the first microphone; wherein the first analog-to-digital converter is configured to operate according to a first audio clock and a first timer;

a first asynchronous sampling rate converter (ASRC) connected to an output terminal of the first ADC;

a first input buffer connected to an output terminal of the first ASRC;

a control circuit communicatively connected to:

the first input buffer;

the first ASRC; and the first audio clock;

a synchronizer circuit communicatively connected to the first timer; and a second earpiece communicatively connected to the first earpiece and comprising:

a second microphone;

a second ADC configured to receive second sound data from the second microphone; wherein the second analog-to-digital converter is configured to operate according to a second audio clock and a second timer;

a second ASRC connected to an output terminal of the second ADC; and a second input buffer connected to an output terminal of the second ASRC;

wherein:

the second timer is communicatively connected to the synchronizer circuit; and the second audio clock is communicatively connected to the control circuit.

14. The audio system according to claim 13, wherein:

the first ADC is electrically connected to the first timer; and the second ADC is connected to the second timer via a wireless connection.

15. The audio system according to claim 13, wherein:

the first input buffer electrically connected to the first microphone and electrically connected to the control circuit; and the second input buffer electrically connected to the second microphone and wirelessly connected to the control circuit.

16. The audio system according to claim 13, wherein the first and second earpieces are wirelessly connected via one of: a Bluetooth wireless communication system and a near-field magnetic induction communication system.

17. The audio system according to claim 13, wherein the audio system is configured to operate in:

an ambient mode that attenuates a first frequency portion of the first and second sound data;

a listening mode that enhances a second frequency portion of the first and second sound data that is produced by a source in a location that is central to the first and second microphones; and a noise cancelling mode that attenuates all frequencies of the first and second sound data.

18. The audio system according to claim 13, wherein the control circuit is configured to:

compare an actual number of samples from the second ASRC to an expected number of samples; and adjust at least one of the first ASRC, the second ASRC, the first audio clock, and the second audio clock according to the comparison.

19. The audio system according to claim 13, wherein the synchronizer circuit is configured to:

determine a wireless travel time from the synchronizer circuit to the second timer; and synchronize the first timer with the second timer according to the wireless travel time.

20. The audio system according to claim 13, further comprising a signal processor located in one of the first earpiece and the second earpiece, and configured to:

receive the first and second sound data; and perform speech enhancement on the first and second sound data using a center channel focus processing method.

* * * * *